US011289821B2

(12) United States Patent
Sanford et al.

(10) Patent No.: US 11,289,821 B2
(45) Date of Patent: Mar. 29, 2022

(54) SECTOR ANTENNA SYSTEMS AND METHODS FOR PROVIDING HIGH GAIN AND HIGH SIDE-LOBE REJECTION

(71) Applicant: AIRSPAN IP HOLDCO LLC, Boca Raton, FL (US)

(72) Inventors: John Sanford, Elfin Forest, CA (US); Brian L. Hinman, Los Gatos, CA (US); Carlos Ramos, San Jose, CA (US); Syed Aon Mujtaba, Santa Clara, CA (US)

(73) Assignee: AIR SPAN IP HOLDCO LLC, Boca Raton, FL (US)

( * ) Notice: Subject to any disclaimer, the term of this patent is extended or adjusted under 35 U.S.C. 154(b) by 228 days.

(21) Appl. No.: 16/563,365

(22) Filed: Sep. 6, 2019

(65) Prior Publication Data

US 2020/0083614 A1 Mar. 12, 2020

Related U.S. Application Data

(60) Provisional application No. 62/729,905, filed on Sep. 11, 2018.

(51) Int. Cl.

| | |
|---|---|
| ***H01Q 1/22*** | (2006.01) |
| ***H01Q 21/00*** | (2006.01) |
| ***H01Q 1/48*** | (2006.01) |

(52) U.S. Cl.

CPC ..... *H01Q 21/0006* (2013.01); *H01Q 1/22* (2013.01); *H01Q 1/48* (2013.01)

(58) Field of Classification Search

CPC .. H01Q 1/22; H01Q 1/48; H01Q 5/50; H01Q 5/385; H01Q 9/0435; H01Q 21/065

See application file for complete search history.

(56) References Cited

U.S. PATENT DOCUMENTS

| | | | |
|---|---|---|---|
| 2,735,993 | A | 2/1956 | Humphrey |
| 3,182,129 | A | 5/1965 | Clark et al. |
| D227,476 | S | 6/1973 | Kennedy |
| 4,188,633 | A | 2/1980 | Frazita |
| 4,402,566 | A | 9/1983 | Powell et al. |
| D273,111 | S | 3/1984 | Hirata et al. |

(Continued)

FOREIGN PATENT DOCUMENTS

| | | | |
|---|---|---|---|
| CN | 104335654 | A | 2/2015 |
| CN | 303453662 | S | 11/2015 |

(Continued)

OTHER PUBLICATIONS

"Extended European Search Report", European Patent Application No. 17835073.2, dated Jun. 30, 2020, 15 pages.

(Continued)

*Primary Examiner* — Tung X Le

(74) *Attorney, Agent, or Firm* — Carr & Ferrell LLP

(57) ABSTRACT

Sector antenna arrays and methods of use that provide high main-lobe gain and high side-lobe rejection over a wide range of operating frequencies are provided herein. The example sector antennas provide these outstanding performance and reliability features due to (1) a cross-section profile for the ground plane, (2) a corporate feed for the linear array of patch antennas, and (3) an optimized sub-assembly of parasitic elements for high bandwidth operation with low return-loss.

20 Claims, 9 Drawing Sheets

(56) References Cited

U.S. PATENT DOCUMENTS 4,543,579 A 9/1985 Teshirogi
4,562,416 A 12/1985 Sedivec
4,626,863 A 12/1986 Knop et al.
4,835,538 A 5/1989 McKenna et al.
4,866,451 A 9/1989 Chen
4,893,288 A 1/1990 Maier et al.
4,903,033 A 2/1990 Tsao et al.
4,986,764 A 1/1991 Eaby et al.
5,015,195 A 5/1991 Piriz
5,087,920 A 2/1992 Tsurumaru et al.
5,226,837 A 7/1993 Cinibulk et al.
5,231,406 A 7/1993 Sreenivas
D346,598 S 5/1994 McCay et al.
D355,416 S 2/1995 McCay et al.
5,389,941 A 2/1995 Yu
5,491,833 A 2/1996 Hamabe
5,513,380 A 4/1996 Ivanov et al.
5,539,361 A 7/1996 Davidovitz
5,561,434 A 10/1996 Yamazaki
D375,501 S 11/1996 Lee et al.
5,580,264 A 12/1996 Aoyama et al.
5,684,495 A 11/1997 Dyott et al.
D389,575 S 1/1998 Grasfield et al.
5,724,666 A 3/1998 Dent
5,742,911 A 4/1998 Dumbrill et al.
5,746,611 A 5/1998 Brown et al.
5,764,696 A 6/1998 Barnes et al.
5,797,083 A 8/1998 Anderson
5,831,582 A 11/1998 Muhlhauser et al.
5,966,102 A 10/1999 Runyon
5,995,063 A 11/1999 Somoza et al.
6,014,372 A 1/2000 Kent et al.
6,067,053 A 5/2000 Runyon et al.
6,137,449 A 10/2000 Kildal
6,140,962 A 10/2000 Groenenboom
6,176,739 B1 1/2001 Denlinger et al.
6,216,266 B1 4/2001 Eastman et al.
6,271,802 B1 8/2001 Clark et al.
6,304,762 B1 10/2001 Myers et al.
D455,735 S 4/2002 Winslow
6,421,538 B1 7/2002 Byrne
6,716,063 B1 4/2004 Bryant et al.
6,754,511 B1 6/2004 Halford et al.
6,847,653 B1 1/2005 Smiroldo
D501,848 S 2/2005 Uehara et al.
6,853,336 B2 2/2005 Asano et al.
6,864,837 B2 3/2005 Runyon et al.
6,877,277 B2 4/2005 Kussel et al.
6,962,445 B2 11/2005 Zimmel et al.
7,075,492 B1 7/2006 Chen et al.
D533,899 S 12/2006 Ohashi et al.
7,173,570 B1 2/2007 Wensink et al.
7,187,328 B2 3/2007 Tanaka et al.
7,193,562 B2 3/2007 Shtrom et al.
7,212,162 B2 5/2007 Jung et al.
7,212,163 B2 5/2007 Huang et al.
7,245,265 B2 7/2007 Kienzle et al.
7,253,783 B2 8/2007 Chiang et al.
7,264,494 B2 9/2007 Kennedy et al.
7,281,856 B2 10/2007 Grzegorzewska et al.
7,292,198 B2 11/2007 Shtrom et al.
7,306,485 B2 12/2007 Masuzaki
7,316,583 B1 1/2008 Mistarz
7,324,057 B2 1/2008 Argaman et al.
D566,698 S 4/2008 Choi et al.
7,362,236 B2 4/2008 Hoiness
7,369,095 B2 5/2008 Hirtzlin et al.
7,380,984 B2 6/2008 Wuester
7,431,602 B2 10/2008 Corona
7,436,373 B1 10/2008 Lopes et al.
7,498,896 B2 3/2009 Shi
7,498,996 B2 3/2009 Shtrom et al.
7,507,105 B1 3/2009 Peters et al.
7,522,095 B1 4/2009 Wasiewicz et al.
7,542,717 B2 6/2009 Green, Sr. et al.
7,581,976 B2 9/2009 Liepold et al.
7,586,891 B1 9/2009 Masciulli
7,616,959 B2 11/2009 Spenik et al.
7,646,343 B2 1/2010 Shtrom et al.
7,675,473 B2 3/2010 Kienzle et al.
7,675,474 B2 3/2010 Shtrom et al.
7,726,997 B2 6/2010 Kennedy et al.
7,778,226 B2 8/2010 Rayzman et al.
7,857,523 B2 12/2010 Masuzaki
7,903,040 B2 * 3/2011 Gevorgian ..... H01P 1/2005 343/787
7,929,914 B2 4/2011 Tegreene
RE42,522 E 7/2011 Zimmel et al.
8,009,646 B2 8/2011 Lastinger et al.
8,069,465 B1 11/2011 Bartholomay et al.
8,111,678 B2 2/2012 Lastinger et al.
8,254,844 B2 8/2012 Kuffner et al.
8,270,383 B2 9/2012 Lastinger et al.
8,275,265 B2 9/2012 Kobyakov et al.
8,325,695 B2 12/2012 Lastinger et al.
8,339,327 B2 * 12/2012 Schadler ..... H01Q 9/0435 343/834
D674,787 S 1/2013 Tsuda et al.
8,345,651 B2 1/2013 Lastinger et al.
8,385,305 B1 2/2013 Negus et al.
8,425,260 B2 4/2013 Seefried et al.
8,482,478 B2 7/2013 Hartenstein
8,515,434 B1 8/2013 Narendran et al.
8,515,495 B2 8/2013 Shang et al.
D694,740 S 12/2013 Apostolakis
8,777,660 B2 7/2014 Chiarelli et al.
8,792,759 B2 7/2014 Benton et al.
8,827,729 B2 9/2014 Gunreben et al.
8,836,601 B2 9/2014 Sanford et al.
8,848,389 B2 9/2014 Kawamura et al.
8,870,069 B2 10/2014 Bellows
8,872,715 B2 * 10/2014 Lea ..... H01Q 1/246 343/797
8,935,122 B2 1/2015 Stisser
9,001,689 B1 4/2015 Hinman et al.
9,019,874 B2 4/2015 Choudhury et al.
9,077,071 B2 7/2015 Shtrom et al.
9,107,134 B1 8/2015 Belser et al.
9,130,305 B2 9/2015 Ramos et al.
9,161,387 B2 10/2015 Fink et al.
9,179,336 B2 11/2015 Fink et al.
9,191,081 B2 11/2015 Hinman et al.
D752,566 S 3/2016 Hinman et al.
9,295,103 B2 3/2016 Fink et al.
9,362,629 B2 6/2016 Hinman et al.
9,391,375 B1 7/2016 Bales et al.
9,407,012 B2 8/2016 Shtrom et al.
9,431,702 B2 8/2016 Hartenstein
9,504,049 B2 11/2016 Hinman et al.
9,531,114 B2 12/2016 Ramos et al.
9,537,204 B2 1/2017 Cheng et al.
9,577,340 B2 2/2017 Fakharzadeh et al.
9,693,388 B2 6/2017 Fink et al.
9,780,892 B2 10/2017 Hinman et al.
9,843,940 B2 12/2017 Hinman et al.
9,871,302 B2 1/2018 Hinman et al.
9,888,485 B2 2/2018 Hinman et al.
9,930,592 B2 3/2018 Hinman
9,949,147 B2 4/2018 Hinman et al.
9,986,565 B2 5/2018 Fink et al.
9,998,246 B2 6/2018 Hinman et al.
10,028,154 B2 7/2018 Elson
10,090,943 B2 10/2018 Hinman et al.
10,096,933 B2 10/2018 Ramos et al.
10,117,114 B2 10/2018 Hinman et al.
10,186,786 B2 1/2019 Hinman et al.
10,200,925 B2 2/2019 Hinman
10,257,722 B2 4/2019 Hinman et al.
10,425,944 B2 9/2019 Fink et al.
10,447,417 B2 10/2019 Hinman et al.
10,511,074 B2 12/2019 Eberhardt et al.
10,595,253 B2 3/2020 Hinman
10,616,903 B2 4/2020 Hinman et al.
10,714,805 B2 7/2020 Eberhardt et al.

(56) References Cited

U.S. PATENT DOCUMENTS 10,742,275 B2 8/2020 Hinman
10,749,263 B2 8/2020 Eberhardt et al.
10,785,608 B2 9/2020 Fink et al.
10,790,613 B2 9/2020 Ramos et al.
10,812,994 B2 10/2020 Hinman et al.
10,863,507 B2 12/2020 Fink et al.
10,938,110 B2 3/2021 Hinman et al.
10,958,332 B2 3/2021 Hinman et al.
11,069,986 B2 7/2021 Sanford et al.
2001/0033600 A1 10/2001 Yang et al.
2002/0102948 A1 8/2002 Stanwood et al.
2002/0159434 A1 10/2002 Gosior et al.
2003/0013452 A1 1/2003 Hunt et al.
2003/0027577 A1 2/2003 Brown et al.
2003/0169763 A1 9/2003 Choi
2003/0222831 A1 12/2003 Dunlap
2003/0224741 A1 12/2003 Sugar et al.
2004/0002357 A1 1/2004 Benveniste
2004/0029549 A1 2/2004 Fikart
2004/0110469 A1 6/2004 Judd et al.
2004/0120277 A1 6/2004 Holur et al.
2004/0155819 A1 8/2004 Martin et al.
2004/0196812 A1 10/2004 Barber
2004/0196813 A1 10/2004 Ofek et al.
2004/0240376 A1 12/2004 Wang et al.
2004/0242274 A1 12/2004 Corbett et al.
2005/0012665 A1 1/2005 Runyon et al.
2005/0032479 A1 2/2005 Miller et al.
2005/0058111 A1 3/2005 Hung et al.
2005/0124294 A1 6/2005 Wentink
2005/0141459 A1 6/2005 Li et al.
2005/0143014 A1 6/2005 Li et al.
2005/0152323 A1 7/2005 Bonnassieux et al.
2005/0195758 A1 9/2005 Chitrapu
2005/0227625 A1 10/2005 Diener
2005/0254442 A1 11/2005 Proctor, Jr. et al.
2005/0271056 A1 12/2005 Kaneko
2005/0275527 A1 12/2005 Kates
2006/0025072 A1 2/2006 Pan
2006/0072518 A1 4/2006 Pan et al.
2006/0098592 A1 5/2006 Proctor, Jr. et al.
2006/0099940 A1 5/2006 Pfleging et al.
2006/0132359 A1 6/2006 Chang et al.
2006/0132602 A1 6/2006 Muto et al.
2006/0172578 A1 8/2006 Parsons
2006/0187952 A1 8/2006 Kappes et al.
2006/0211430 A1 9/2006 Persico
2006/0276073 A1 12/2006 McMurray et al.
2007/0001910 A1 1/2007 Yamanaka et al.
2007/0019664 A1 1/2007 Benveniste
2007/0035463 A1 2/2007 Hirabayashi
2007/0060158 A1 3/2007 Medepalli et al.
2007/0132643 A1 6/2007 Durham et al.
2007/0173199 A1 7/2007 Sinha
2007/0173260 A1 7/2007 Love et al.
2007/0202809 A1 8/2007 Lastinger et al.
2007/0210974 A1 9/2007 Chiang
2007/0223701 A1 9/2007 Emeott et al.
2007/0238482 A1 10/2007 Rayzman et al.
2007/0255797 A1 11/2007 Dunn et al.
2007/0268848 A1 11/2007 Khandekar et al.
2008/0109051 A1 5/2008 Splinter et al.
2008/0112380 A1 5/2008 Fischer
2008/0192707 A1 8/2008 Xhafa et al.
2008/0218418 A1 9/2008 Gillette
2008/0231541 A1 9/2008 Teshirogi et al.
2008/0242342 A1 10/2008 Rofougaran
2009/0046673 A1 2/2009 Kaidar
2009/0051597 A1 2/2009 Wen et al.
2009/0052362 A1 2/2009 Meier et al.
2009/0059794 A1 3/2009 Frei
2009/0075606 A1 3/2009 Shtrom et al.
2009/0096699 A1 4/2009 Chiu et al.
2009/0232026 A1 9/2009 Lu
2009/0233475 A1 9/2009 Mildon et al.
2009/0291690 A1 11/2009 Guvenc et al.
2009/0315792 A1 12/2009 Miyashita et al.
2010/0029282 A1 2/2010 Stamoulis et al.
2010/0034191 A1 2/2010 Schulz
2010/0039340 A1 2/2010 Brown
2010/0046650 A1 2/2010 Jongren et al.
2010/0067505 A1 3/2010 Fein et al.
2010/0085950 A1 4/2010 Sekiya
2010/0091818 A1 4/2010 Sen et al.
2010/0103065 A1 4/2010 Shtrom et al.
2010/0103066 A1 4/2010 Shtrom et al.
2010/0119002 A1 5/2010 Hartenstein
2010/0136978 A1 6/2010 Cho et al.
2010/0151877 A1 6/2010 Lee et al.
2010/0167719 A1 7/2010 Sun
2010/0171665 A1 7/2010 Nogami
2010/0171675 A1 7/2010 Borja et al.
2010/0177660 A1 7/2010 Essinger et al.
2010/0189005 A1 7/2010 Bertani et al.
2010/0202613 A1 8/2010 Ray et al.
2010/0210147 A1 8/2010 Hauser
2010/0216412 A1 8/2010 Rofougaran
2010/0225529 A1 9/2010 Landreth et al.
2010/0238083 A1 9/2010 Malasani
2010/0304680 A1 12/2010 Kuffner et al.
2010/0311321 A1 12/2010 Norin
2010/0315307 A1 12/2010 Syed et al.
2010/0322219 A1 12/2010 Fischer et al.
2011/0006956 A1 1/2011 McCown
2011/0028097 A1 2/2011 Memik et al.
2011/0032159 A1 2/2011 Wu et al.
2011/0044186 A1 2/2011 Jung et al.
2011/0090129 A1 4/2011 Weily et al.
2011/0103309 A1 5/2011 Wang et al.
2011/0111715 A1 5/2011 Buer et al.
2011/0112717 A1 5/2011 Resner
2011/0133996 A1 6/2011 Alapuranen
2011/0170424 A1 7/2011 Safavi
2011/0172916 A1 7/2011 Pakzad et al.
2011/0182260 A1 7/2011 Sivakumar et al.
2011/0182277 A1 7/2011 Shapira
2011/0194644 A1 8/2011 Liu et al.
2011/0206012 A1 8/2011 Youn et al.
2011/0241969 A1 10/2011 Zhang et al.
2011/0243291 A1 10/2011 McAllister et al.
2011/0256874 A1 10/2011 Hayama et al.
2011/0291914 A1 12/2011 Lewry et al.
2012/0008542 A1 1/2012 Koleszar et al.
2012/0040700 A1 2/2012 Gomes et al.
2012/0057533 A1 3/2012 Junell et al.
2012/0093091 A1 4/2012 Kang et al.
2012/0115487 A1 5/2012 Josso
2012/0134280 A1 5/2012 Rotvold et al.
2012/0139786 A1 6/2012 Puzella et al.
2012/0140651 A1 6/2012 Nicoara et al.
2012/0200449 A1 8/2012 Bielas
2012/0238201 A1 9/2012 Du et al.
2012/0263145 A1 10/2012 Marinier et al.
2012/0282868 A1 11/2012 Hahn
2012/0299789 A1 11/2012 Orban et al.
2012/0314634 A1 12/2012 Sekhar
2013/0003645 A1 1/2013 Shapira et al.
2013/0005350 A1 1/2013 Campos et al.
2013/0023216 A1 1/2013 Moscibroda et al.
2013/0044028 A1 2/2013 Lea et al.
2013/0063310 A1* 3/2013 Mak ..... H01Q 21/08
343/700 MS
2013/0064161 A1 3/2013 Hedayat et al.
2013/0082899 A1 4/2013 Gomi
2013/0095747 A1 4/2013 Moshfeghi
2013/0128858 A1 5/2013 Zou et al.
2013/0176902 A1 7/2013 Wentink et al.
2013/0182652 A1 7/2013 Tong et al.
2013/0195081 A1 8/2013 Merlin et al.
2013/0210457 A1 8/2013 Kummetz
2013/0223398 A1 8/2013 Li et al.
2013/0234898 A1 9/2013 Leung et al.
2013/0271319 A1 10/2013 Trerise
2013/0286950 A1 10/2013 Pu

(56) References Cited

U.S. PATENT DOCUMENTS

| | | | | |
|---|---|---|---|---|
| 2013/0286959 | A1 | 10/2013 | Lou et al. | |
| 2013/0288735 | A1 | 10/2013 | Guo | |
| 2013/0301438 | A1 | 11/2013 | Li et al. | |
| 2013/0322276 | A1 | 12/2013 | Pelletier et al. | |
| 2013/0322413 | A1 | 12/2013 | Pelletier et al. | |
| 2014/0024328 | A1 | 1/2014 | Balbien et al. | |
| 2014/0051357 | A1 | 2/2014 | Steer et al. | |
| 2014/0098748 | A1 | 4/2014 | Chan et al. | |
| 2014/0113676 | A1 | 4/2014 | Hamalainen et al. | |
| 2014/0145890 | A1 | 5/2014 | Ramberg et al. | |
| 2014/0154895 | A1 | 6/2014 | Poulsen et al. | |
| 2014/0185494 | A1 | 7/2014 | Yang et al. | |
| 2014/0191918 | A1 | 7/2014 | Cheng et al. | |
| 2014/0198867 | A1 | 7/2014 | Sturkovich et al. | |
| 2014/0206322 | A1 | 7/2014 | Dimou et al. | |
| 2014/0225788 | A1 | 8/2014 | Schulz et al. | |
| 2014/0233613 | A1 | 8/2014 | Fink et al. | |
| 2014/0235244 | A1 | 8/2014 | Hinman | |
| 2014/0240186 | A1 | 8/2014 | Zhou et al. | |
| 2014/0253378 | A1 | 9/2014 | Hinman | |
| 2014/0253402 | A1 | 9/2014 | Hinman et al. | |
| 2014/0254700 | A1 | 9/2014 | Hinman et al. | |
| 2014/0256166 | A1 | 9/2014 | Ramos et al. | |
| 2014/0320306 | A1 | 10/2014 | Winter | |
| 2014/0320377 | A1 | 10/2014 | Cheng et al. | |
| 2014/0328238 | A1 | 11/2014 | Seok et al. | |
| 2014/0341013 | A1 | 11/2014 | Kumar | |
| 2014/0355578 | A1 | 12/2014 | Fink et al. | |
| 2014/0355584 | A1 | 12/2014 | Fink et al. | |
| 2015/0002335 | A1 | 1/2015 | Hinman et al. | |
| 2015/0002354 | A1 | 1/2015 | Knowles | |
| 2015/0015435 | A1 | 1/2015 | Shen et al. | |
| 2015/0116177 | A1 | 4/2015 | Powell et al. | |
| 2015/0156642 | A1 | 6/2015 | Sobczak et al. | |
| 2015/0215952 | A1 | 7/2015 | Hinman et al. | |
| 2015/0244077 | A1* | 8/2015 | Sanford | H01Q 13/02 343/776 |
| 2015/0256213 | A1 | 9/2015 | Jan et al. | |
| 2015/0256275 | A1 | 9/2015 | Hinman et al. | |
| 2015/0263816 | A1 | 9/2015 | Hinman et al. | |
| 2015/0319584 | A1 | 11/2015 | Fink et al. | |
| 2015/0321017 | A1 | 11/2015 | Perryman et al. | |
| 2015/0325945 | A1 | 11/2015 | Ramos et al. | |
| 2015/0327272 | A1 | 11/2015 | Fink et al. | |
| 2015/0365866 | A1 | 12/2015 | Hinman et al. | |
| 2016/0119018 | A1 | 4/2016 | Lindgren et al. | |
| 2016/0149634 | A1 | 5/2016 | Kalkunte et al. | |
| 2016/0149635 | A1 | 5/2016 | Hinman et al. | |
| 2016/0211583 | A1 | 7/2016 | Lee et al. | |
| 2016/0240929 | A1 | 8/2016 | Hinman et al. | |
| 2016/0338076 | A1 | 11/2016 | Hinman et al. | |
| 2016/0365666 | A1 | 12/2016 | Ramos et al. | |
| 2016/0366601 | A1 | 12/2016 | Hinman et al. | |
| 2017/0048647 | A1 | 2/2017 | Jung et al. | |
| 2017/0201028 | A1 | 7/2017 | Eberhardt et al. | |
| 2017/0238151 | A1 | 8/2017 | Fink et al. | |
| 2017/0294975 | A1 | 10/2017 | Hinman et al. | |
| 2017/0353245 | A1 | 12/2017 | Vardarajan et al. | |
| 2018/0034166 | A1 | 2/2018 | Hinman | |
| 2018/0035317 | A1 | 2/2018 | Hinman et al. | |
| 2018/0083365 | A1 | 3/2018 | Hinman et al. | |
| 2018/0084563 | A1 | 3/2018 | Hinman et al. | |
| 2018/0102594 | A1* | 4/2018 | Murdock | H01Q 9/045 |
| 2018/0160353 | A1 | 6/2018 | Hinman | |
| 2018/0167105 | A1 | 6/2018 | Vannucci et al. | |
| 2018/0192305 | A1 | 7/2018 | Hinman et al. | |
| 2018/0199345 | A1 | 7/2018 | Fink et al. | |
| 2018/0241491 | A1 | 8/2018 | Hinman et al. | |
| 2019/0006789 | A1 | 1/2019 | Ramos et al. | |
| 2019/0115664 | A1* | 4/2019 | Veihl | H01Q 5/385 |
| 2019/0182686 | A1 | 6/2019 | Hinman et al. | |
| 2019/0214699 | A1 | 7/2019 | Eberhardt et al. | |
| 2019/0215745 | A1 | 7/2019 | Hinman | |
| 2019/0273326 | A1 | 9/2019 | Sanford et al. | |
| 2020/0015231 | A1 | 1/2020 | Fink et al. | |
| 2020/0036465 | A1 | 1/2020 | Hinman et al. | |
| 2020/0067164 | A1 | 2/2020 | Eberhardt et al. | |
| 2021/0167510 | A1 | 6/2021 | Hinman et al. | |
| 2021/0167842 | A1 | 6/2021 | Hinman et al. | |
| 2021/0273346 | A1 | 9/2021 | Sanford et al. | |

FOREIGN PATENT DOCUMENTS

| | | | |
|---|---|---|---|
| CN | 105191204 | A | 12/2015 |
| CN | 105191204 | B | 5/2019 |
| EM | 002640177 | | 2/2015 |
| EP | 1384285 | B1 | 6/2007 |
| EP | 3208887 | A1 | 2/2017 |
| EP | 3491697 | A1 | 6/2019 |
| WO | WO2014137370 | A1 | 9/2014 |
| WO | WO2014138292 | A1 | 9/2014 |
| WO | WO2014193394 | A1 | 12/2014 |
| WO | WO2015112627 | A1 | 7/2015 |
| WO | WO2017123558 | A1 | 7/2017 |
| WO | WO2018022526 | A1 | 2/2018 |
| WO | WO2019136257 | A1 | 7/2019 |
| WO | WO2019168800 | A1 | 9/2019 |

OTHER PUBLICATIONS

Haupt, R.T., "Antenna Arrays: A Computational Approach", Chapter 5: Non-Planar Arrays; Wiley—IEEE Press (2010), pp. 287-338.

"International Search Report" and "Written Opinion of the International Search Authority," dated Nov. 26, 2013 in Patent Cooperation Treaty Application No. PCT/US2013/047406, filed Jun. 24, 2013, 9 pages.

"International Search Report" and "Written Opinion of the International Search Authority," dated Aug. 9, 2013 in Patent Cooperation Treaty Application No. PCT/US2013/043436, filed May 30, 2013, 13 pages.

"International Search Report" and "Written Opinion of the International Search Authority," dated Jul. 1, 2014 in Patent Cooperation Treaty Application No. PCT/US2014/020880, filed Mar. 5, 2014, 14 pages.

"International Search Report" and "Written Opinion of the International Search Authority," dated Jun. 29, 2015 in Patent Cooperation Treaty Application No. PCT/US2015/012285, filed Jan. 21, 2015, 15 pages.

Hinman et al., U.S. Appl. No. 61/774,532, filed Mar. 7, 2013, 23 pages.

"Office Action," Chinese Design Patent Application 201530058063.8, dated Jun. 15, 2015, 1 page.

"Notice of Allowance,"Chinese Design Patent Application 201530058063.8, dated Sep. 8, 2015, 3 pages.

Weisstein, Eric, "Electric Polarization", Wolfram Reasearch [online], Retrieved from the Internet [retrieved Mar. 23, 2017] <URL:http://scienceworld.wolfram.com/physics/ElectricPolarization.html>, 2007, 1 page.

Liu, Lingjia et al., "Downlink MIMO in LTE-Advanced: SU-MIMOvs. MU-MIMO," IEEE Communications Magazine, Feb. 2012, pp. 140-147.

"International Search Report" and "Written Opinion of the International Searching Authority," Patent Cooperation Treaty Application No. PCT/US2017/012884, dated Apr. 6, 2017, 9 pages.

"Office Action," Chinese Patent Application No. 201580000078.6, dated Nov. 3, 2017, 5 pages [10 pages including translation].

"International Search Report" and "Written Opinion of the International Searching Authority," Patent Cooperation Treaty Application No. PCT/US2017/043560, dated Nov. 16, 2017, 11 pages.

"Office Action," Chinese Patent Application No. 201580000078.6, dated Jul. 30, 2018, 5 pages [11 pages including translation].

"Office Action," Chinese Patent Application No. 201580000078.6, dated Oct. 31, 2018, 3 pages [6 pages including translation].

"Notice of Allowance," Chinese Patent Application No. 201580000078.6, dated Feb. 11, 2019, 2 pages [4 pages including translation].

"International Search Report" and "Written Opinion of the International Search Authority," dated Mar. 22, 2019 in Patent Cooperation Treaty Application No. PCT/US2019/012358, filed Jan. 4, 2019, 9 pages.

(56) References Cited

OTHER PUBLICATIONS

FCC Regulations, 47 CFR § 15.407, 63 FR 40836, dated Jul. 31, 1998, as amended at 69 FR 2687, dated Jan. 20, 2004; 69 FR 54036, dated Sep. 7, 2004; pp. 843-846.
"International Search Report" and "Written Opinion of the International Search Authority," dated May 23, 2019 in Patent Cooperation Treaty Application No. PCT/US2019/019462, filed Feb. 25, 2019, 8 pages.
Teshirogi, Tasuku et al., "Wideband Circularly Polarized Array Antenna with Sequential Rotations and Phase Shift of Elements," Proceedings of the International Symposium on Antennas and Propagation, 1985, pp. 117-120.
"Sector Antennas," Radiowaves.com, [online], [retrieved Oct. 10, 2019], Retrieved from the Internet: <URL:https://www.radiowaves.com/en/products/sector-antennas>, 4 pages.
KP Performance Antennas Search Results for Antennas, Sector, Single, [online], KPPerformance.com [retrieved Oct. 10, 2019], Retrieved from the Internet: <URL:https://www.kpperformance.com/search?Category=Antennas&Rfpsan99design=Sector&Rfpsan99option=Single&view_type=grid>, 6 pages.
"Partial Supplemental European Search Report," European Patent Application No. 17835073.2, dated Feb. 13, 2020, 17 pages.
"Wireless Access Point," Wikipedia.org, Jan. 6, 2020 [retrieved on Feb. 3, 2020], Retrieved from the Internet: <https://en.wikipedia.org/wiki/Wireless_access_point>, 5 pages.
Dowla, Farid et al., "RF and Wireless Technologies: Know It All", Netherlands, Elsevier Science, 2008, p. 314.
"Office Action", European Patent Application No. 17835073.2, dated Jun. 1, 2021, 10 pages.

* cited by examiner

SECTOR ANTENNA SYSTEMS AND METHODS FOR PROVIDING HIGH GAIN AND HIGH SIDE-LOBE REJECTION

CROSS REFERENCE TO RELATED APPLICATIONS

This application claims the benefit and priority of U.S. Provisional Application Ser. No. 62/729,905, filed on Sep. 11, 2018, which is hereby incorporated by reference herein including all references and appendices cited therein.

FIELD OF THE INVENTION

The present disclosure pertains to sector antennas, and more specifically, but not by limitation to sector antenna systems and methods for providing high-gain and high side-lobe rejection.

BACKGROUND OF THE INVENTION

Antennas are useful in radio frequency and wireless technologies. Radio frequency technology utilizes radio waves to transmit audio signals. Wireless technologies allow for transmission of data or information to other devices over distances. Antennas help facilitate the transmission of communication signals or data to one or more remote clients.

SUMMARY

In one aspect, the present disclosure is directed to a sector antenna system, comprising: a linear antenna array for the sector antenna, configured to implement slant 45-degree polarizations, to exploit beamforming gain, the linear antenna array comprising a plurality of patch antenna elements that are connected through a corporate feed, the linear antenna array located on a printed circuit board (PCB) of the sector antenna, each of the plurality of patch antenna elements having bi-level parasitic patch element assemblies of varying diameter discs, for high bandwidth operation with low return-loss, the PCB having two layers comprising the corporate feed and a ground plane, the two layers separated by a dielectric substrate, with chokes disposed on opposing sides of the PCB for high side-lobe rejection; and the ground plane having a cross-section profile configured in such a way as to support the linear antenna array on the PCB, in order to increase main-lobe gain and side-lobe rejection.

In another aspect, the present disclosure is directed to a sector antenna system comprising: a linear antenna array for the sector antenna, configured to implement slant 45-degree polarizations, to exploit beamforming gain, the linear antenna array comprising a plurality of patch antenna elements that are connected through a corporate feed, the linear antenna array located on a printed circuit board (PCB) of the sector antenna, each of the plurality of patch antenna elements having parasitic patch element assemblies, the PCB having two layers comprising the corporate feed and a ground plane, the two layers being separated by a dielectric substrate, with chokes disposed on opposing sides of the PCB for high side-lobe rejection; and the ground plane having a cross-section profile configured in such a way as to support the linear antenna array on the PCB, in order to increase main-lobe gain and side-lobe rejection.

In another aspect, the present disclosure is directed to a linear array for a sector antenna comprising: a plurality of patch antenna elements that are connected through a corporate feed and are arranged for high antenna gain, the linear antenna array located on a printed circuit board (PCB) of the sector antenna, each of the plurality of patch antenna elements having parasitic patch element assemblies, the PCB having two layers comprising the corporate feed and a ground plane, the two layers being separated by a dielectric substrate, with chokes disposed on opposing sides of the PCB for high side-lobe rejection.

BRIEF DESCRIPTION OF THE DRAWINGS

Certain embodiments of the present technology are illustrated by the accompanying figures. It will be understood that the figures are not necessarily to scale and that details not necessary for an understanding of the technology or that render other details difficult to perceive may be omitted. It will be understood that the technology is not necessarily limited to the particular embodiments illustrated herein.

DETAILED DESCRIPTION

Figure 1A:
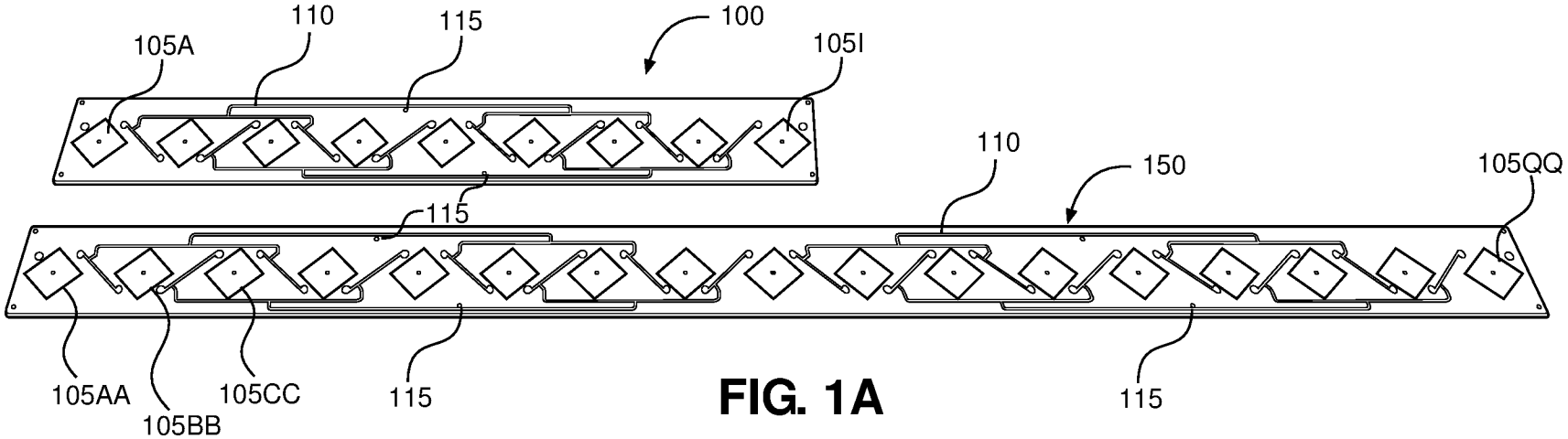
FIG. 1A are top views of example printed circuit boards for sector antennas, in accordance with the present disclosure.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated.

It will be understood that like or analogous elements and/or components, referred to herein, may be identified throughout the drawings with like reference characters. It will be further understood that several of the figures are merely schematic representations of the present technology. As such, some of the components may have been distorted from their actual scale for pictorial clarity.

High-gain antennas are desirable for a wide range of applications, since higher gain helps improve radio frequency (RF) or wireless link performance and reliability. Antenna gain can be increased by reducing the beamwidth in either the elevation plane (also referred to as the vertical plane), the azimuth plane (also referred to as the horizontal plane), or both planes. In other words, the narrower the beamwidth, the higher the gain.

In addition to antenna gain, another aspect of desirable antenna performance is "sidelobe rejection." High sidelobe rejection allows the antenna to suppress or reject RF energy coming from non-desirable directions, thereby reducing noise and interference coming into the antenna.

An ideal antenna would be one that has high gain in the desired direction, minimal gain in the non-desirable direction, and sufficiently broad coverage in the azimuth plane.

High-gain antennas tend to come in three physical forms: (a) sectors, (b) horns, or (c) parabolic dishes. Access Point (or base station) antennas for Fixed Wireless Access (FWA) applications tend to use either sector antennas or horn antennas, since radiation patterns from the access point need to cover a broad enough angle in the azimuth plane. To this end, beamwidth of sector antennas in the azimuth plane is typically between 40 degrees and 120 degrees, whereas the beamwidth in the elevation plane is expected to much less (typically less than 10 degrees). If the azimuth bandwidth is too narrow, this increases the cost of network deployment, since more antennas are required at the tower or cell site to provide coverage at 360 degrees. Horn antennas, on the other hand, tend to have comparable beamwidths in both the azimuth and elevation planes, making them less efficient in spanning a large surface area in the azimuth/horizontal plane. However, horn antennas typically have better side-lobe rejection compared to sector antennas.

The present disclosure provides innovative systems and methods of sector antennas that provide high main-lobe gain and high side-lobe rejection over a wide range of operating frequencies. The sector antennas provided in the present disclosure provides these outstanding performance features thanks to (1) a cross-section profile for the ground plane, (2) a corporate feed for the linear array of patch antennas, and (3) an optimized sub-assembly of parasitic elements for high bandwidth operation with low return-loss. These sector antennas are designed to operate over the entire spectrum of 4.9 GHz to 6.4 GHz.

The present disclosure further provides sector antenna designs that achieve a high-gain directional radiation pattern over a wide frequency range of operation, are dual-polarized for maximum spectral efficiency, and employ a linear array within each polarization to exploit beamforming gain. Exemplary sector antenna designs described later herein include both the two-port sector antenna (also known as the two-port model) and the four-port sector antenna (also known as the four-port model). The two-port sector antenna can work well with third party radios, whereas the four-port sector antenna is intended to work with the Mimosa A5c proprietary access point (AP). The linear array of the sector antenna designs implements slant 45-degree polarizations by means of patch antenna elements that are connected through a corporate feed network. "Slant 45-degree polarization" means that one polarization is +45 degrees with respect to the vertical axis, and the other polarization is −45 degrees with respect to the vertical axis. Furthermore, each patch element has bi-level parasitic elements of varying diameter discs, optimally spaced for antenna performance.

Sector antennas can be formed using a vertical array of antenna elements placed over a metallic ground plane. The resulting antennas, often using two polarizations, have a relatively narrow elevation beam-width, while maintaining the azimuthal beam-width as 60, 90, or 120 degrees, typically.

Physical antenna gain is often achieved by arraying a set of antenna elements together, increasing the directionality of the array. The tradeoff of employing antenna arrays is limiting the directionality to a more narrow angular range. As a general observation, humans tend to live and work within a narrow elevation angle relative to the surface of the earth. Thus, it is often practical to create vertical arrays of antenna elements, which has the effect of increasing the gain of the array, while reducing the elevation beam-width. Cellular antenna panels, as an example, have been designed as arrays of vertical elements for many years.

Also, outdoor Wi-Fi is less popular than indoor Wi-Fi today. Typical use cases include Wi-Fi and Wi-Fi-derived radios for fixed access, and Wi-Fi access points in large venue and hospitality applications. In the latter case, the products deployed are often weatherized versions of those found in indoor applications.

The design of the exemplary sector antennas in the present disclosure are based on a vertical array to achieve a specified beamwidth in the elevation plane, and hence obtain high antenna gain. The example sector antennas are typically mounted on a support structure such as a pole such as to transmit signals over long distances to remote clients. With the help of these sector antennas, one can achieve superior data rates and speeds.

FIG. 1A depict top views of two example printed circuit boards for two sector antennas, in accordance with the present disclosure. Specifically, a printed circuit board (PCB) 100 for the two-port sector antenna (two-port model) is shown. Also, a printed circuit board 150 for four-port sector antenna (four-port model) is shown.

The two-port model design comprises a linear array of nine patch elements 105A-I corresponding with nine parasitic patch elements assemblies. An exemplary parasitic patch element assembly in a sector antenna is depicted as element 210 in FIG. 2A, which will be discussed later herein. For both the two-port model and the four-port model design, the PCB consists of two layers, namely, the top layer (the corporate feed), and the bottom layer (the ground plane). Both layers of the PCB are separated by a dielectric substrate.

In some embodiments, the elements of the antennas are arrayed using a fixed network of interconnect. In one embodiment, the fixed network of interconnect comprises a corporate feed where the lines connecting the elements receive signals at approximately the same time. Also, in some embodiments antenna elements can be configured in-phase. In general, a vertical array of elements is pointed perpendicularly to a reference plane, such as the horizon. When wire lengths interconnecting elements (such as in a corporate feed) are equal, there is in-phase alignment of signals received from near the horizon, which gives rise to constructive interference at a terminal end of the corporate feed.

In some embodiments according to the present disclosure, a series of antenna elements are connected in a linear array. This allows for a higher antenna gain by narrowing the reception pattern in the angle common to the linear array. A series fed array provides for a narrow physical design, as the connection between the elements is along the center line of the array. However, a series fed array suffers from a strong frequency dependency with respect to a far-field response. Thus, many linear antenna arrays utilize the corporate feed, whereby the elements are fed with a hierarchy of traces intended to equalize the path lengths.

Each of the antenna arrays of the sector antennas consists of individual antenna patch elements, arranged vertically, connected through the corporate feed. The patch antenna array and corporate fed are designed on the PCB. The corporate feed layer of the PCB includes a corporate feed network 110 that is located on a surface of the PCB and is electrically coupled to the PCB. Furthermore, a plurality of feed points 115 is located on the PCB. The patch elements 105A-I for the two-port model are linearly arrayed through the corporate feed in such a way that the antenna gain of the antenna arrays is increased while the elevation beam-width produced by the antenna arrays is reduced. The patch elements 105A-I are generally placed over a metallic ground plane, which has the effect of creating directivity. The ground plane and its importance to the sector antennas will be described in greater detail in reference to FIG. 7, as provided below.

Each patch element within the linear array of the sector antenna, for both the two-port and four-port models, is dual polarized at −45 degree and +45 degree polarizations. One example of the +45-degree polarization is the copper PCB trace from the corporate feed network 110, entering the patch element (such as the patch element 105A in FIG. 1) at a 45-degree angle with respect to the vertical or the horizontal axis. One example of the −45-degree polarization is the copper PCB trace from the corporate feed network 110, entering the patch element (such as the patch element 105A in FIG. 1) at a negative 45-degree angle with respect to the vertical or the horizontal axis. Also, each patch element within the linear array of the sector antenna, for both the two-port and four-port models, is fed using the corporate feed to provide a wide bandwidth of operation.

The four-port model is similar to the two-port model in certain aspects, but notably, the four-port model comprises a linear array of seventeen patch elements 105AA-QQ (instead of the nine patch elements 105A-I of the two-port model), corresponding with seventeen parasitic patch elements assemblies. An exemplary parasitic patch element assembly in a sector antenna is shown as element 210 in FIG. 2A, which will be discussed later herein. The PCB for the four-port model 150 with its corporate feed network 110 and a plurality of feed points 115 is also illustrated in FIG. 1A.

Figure 1B:
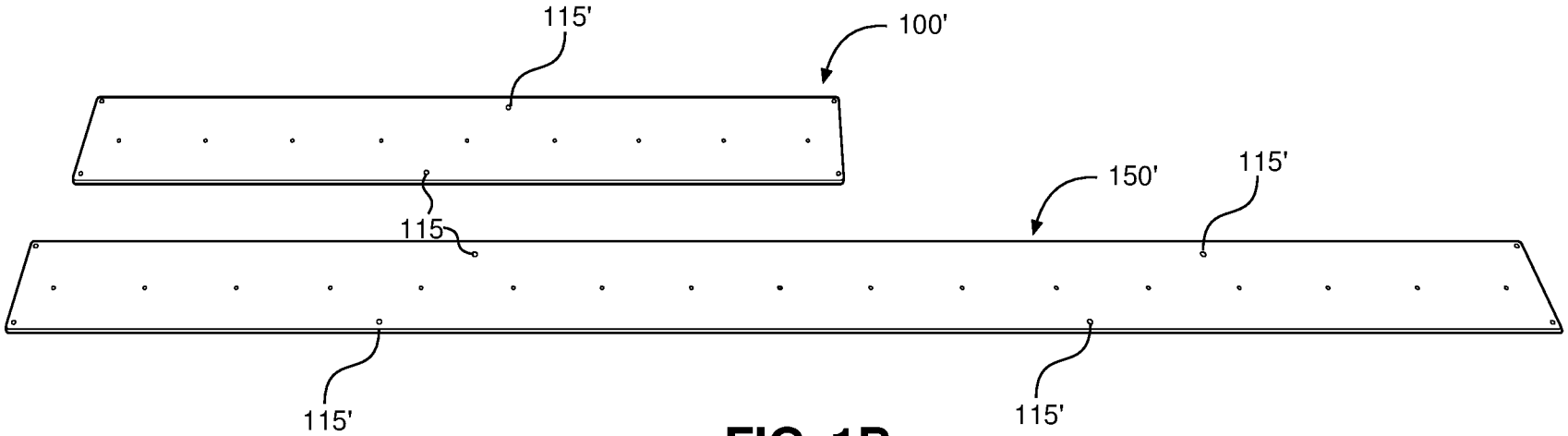
FIG. 1B are back views of example printed circuit boards for sector antennas, in accordance with the present disclosure.

FIG. 1B are back views of example printed circuit boards for the two-port and four-port sector antennas, in accordance with the present disclosure. The backsides of the PCBs have a copper ground plane. FIG. 1B also depicts the plurality of feed points 115 on the PCBs of the sector antennas.

Figure 2A:
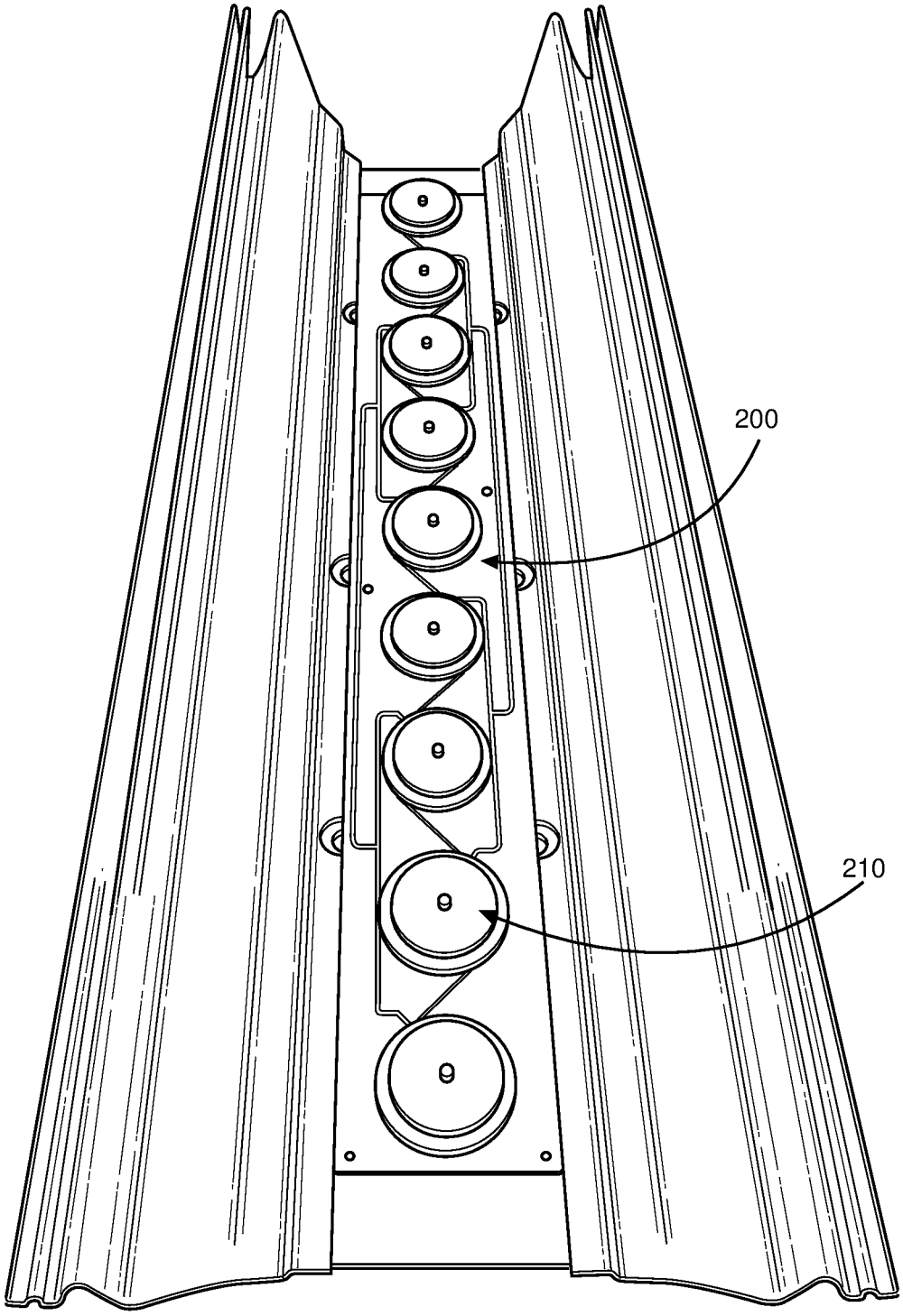
FIG. 2A is a top view of an array of an example two-port sector antenna.

FIG. 2A is a top view of an array 200 of a two-port sector antenna, in accordance with the present disclosure. The array 200 comprises nine parasitic patch elements assemblies that correspond with the nine patch elements 105A-I on the PCB 100 in FIG. 1A. Parasitic patch element assemblies are placed above driven patch elements, which are typically mounted on a low-loss substrate over a ground plane.

Figure 3:
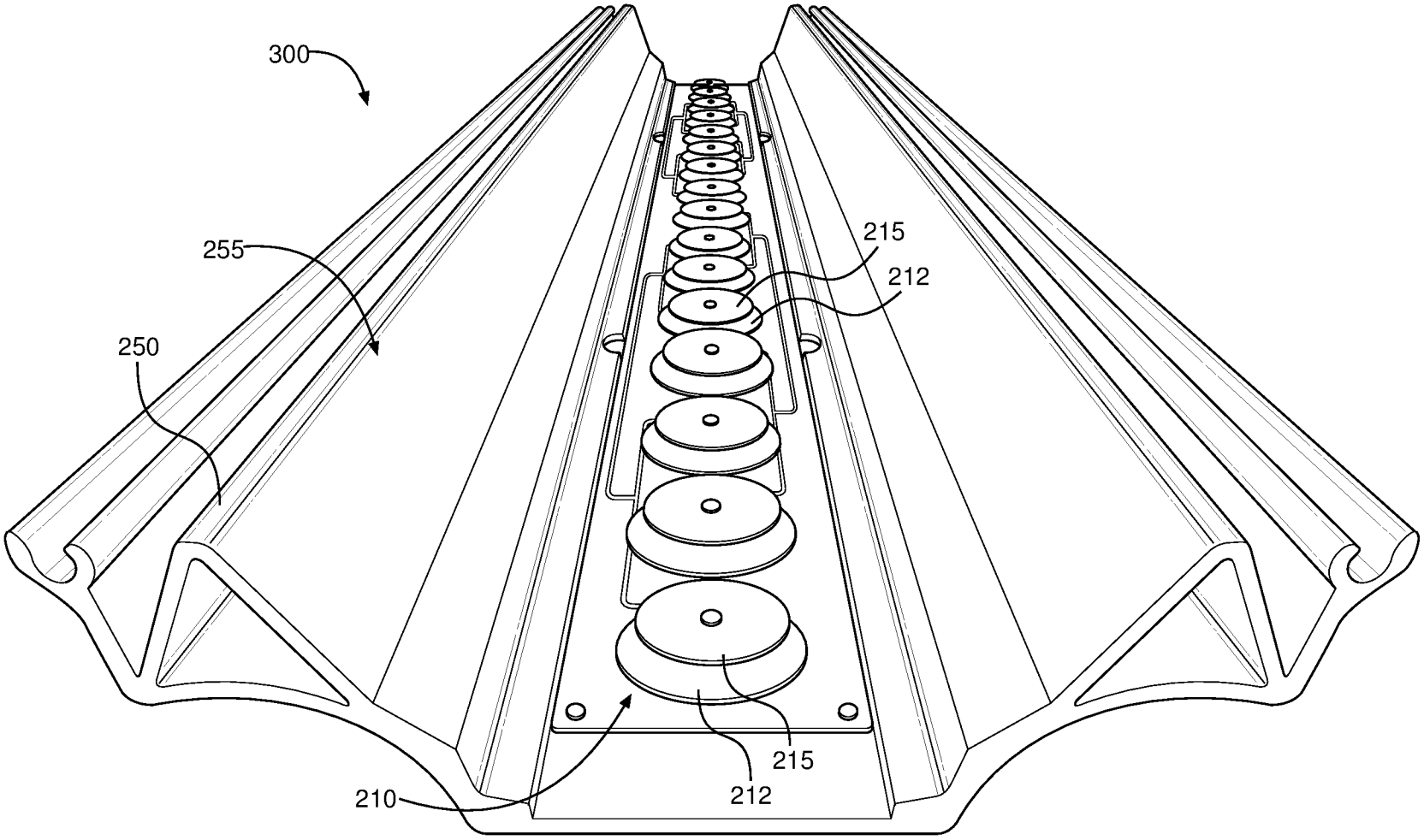
FIG. 3 is a top side view of an array of an example four-port sector antenna.

An exemplary parasitic patch element assembly is depicted as element 210. The parasitic elements improve the efficiency and bandwidth of a sector antenna. As shown in FIGS. 2A and 3, in some embodiments, the parasitic patch element assemblies may be optimally spaced for antenna performance, on the surface of the PCB.

Figure 2B:
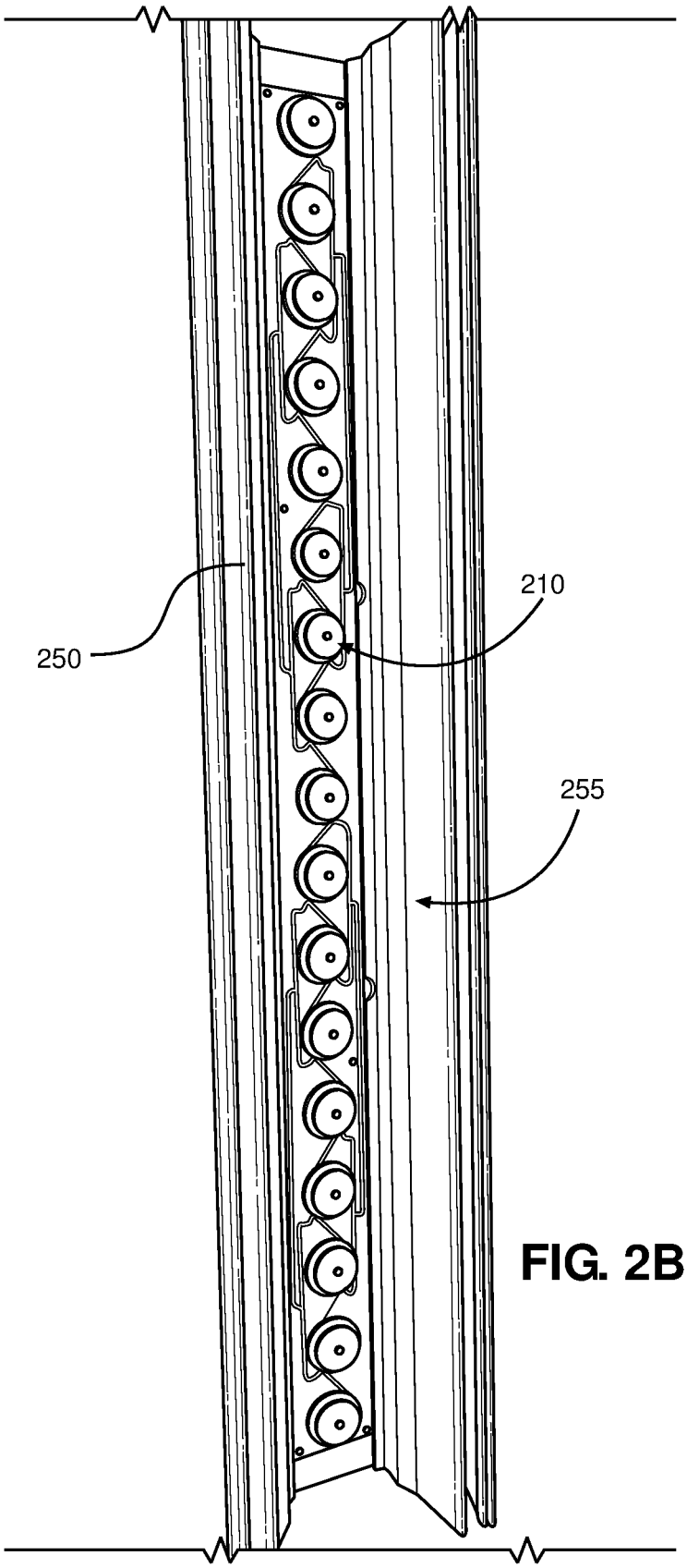
FIG. 2B is a top view of an array of an example four-port sector antenna.

FIG. 2B is a top view of an array 255 for a four-port sector antenna, in accordance with the present disclosure. The array 255 of the four-port sector antenna is similar to the array 200 of a two-port sector antenna in certain aspects, but notably the array 255 of the four-port sector antenna comprises seventeen parasitic patch elements assemblies (instead of the nine parasitic patch elements assemblies in the two-port model) that correspond with the seventeen patch elements 105AA-QQ on the PCB 150 in FIG. 1A.

FIG. 3 is a top side view of the array 255 of an example four-port sector antenna, in accordance with the present disclosure. The array 255 is linear and comprises seventeen parasitic patch elements assemblies that correspond with the seventeen patch elements 105AA-QQ on the PCB 150 in FIG. 1A. An exemplary parasitic patch element assembly 210 of the array 255 is shown.

Each of the parasitic patch assemblies, for both the two-port model and the four-port model, are bi-level and are assembled at each printed circuit patch element, and electrically shorted to each PCB patch element, to improve the beamwidth and bandwidth performance. Each of the patch elements, for both the two-port model and the four-port model, has a bi-level parasitic patch assembly comprising two discs 212 and 215 having varying diameters, optimally spaced for antenna performance.

It should be noted that there is a specific metal geometry shape 250 unique for antenna performance as depicted in FIG. 3. As described in further detail regarding FIGS. 7A-E, in accordance with various embodiments of the present technology, the prescribed geometry of the metal or metalized structure supports an antenna PCB for a long and narrow sector antenna. The antenna PCB is located in the center groove of the structure, with a plurality of antenna elements approximately located in the middle of the PCB, and a choke disposed on opposing sides of the PCB. The chokes disposed on the opposing sides of the PCB act like speedbumps to antenna signals, which allow for high sidelobe rejection, and thus mitigate interference as much as possible. Thus, the sector antennas described herein are optimized towards the goal of maximizing gain and minimizing side lobes.

Figure 4:
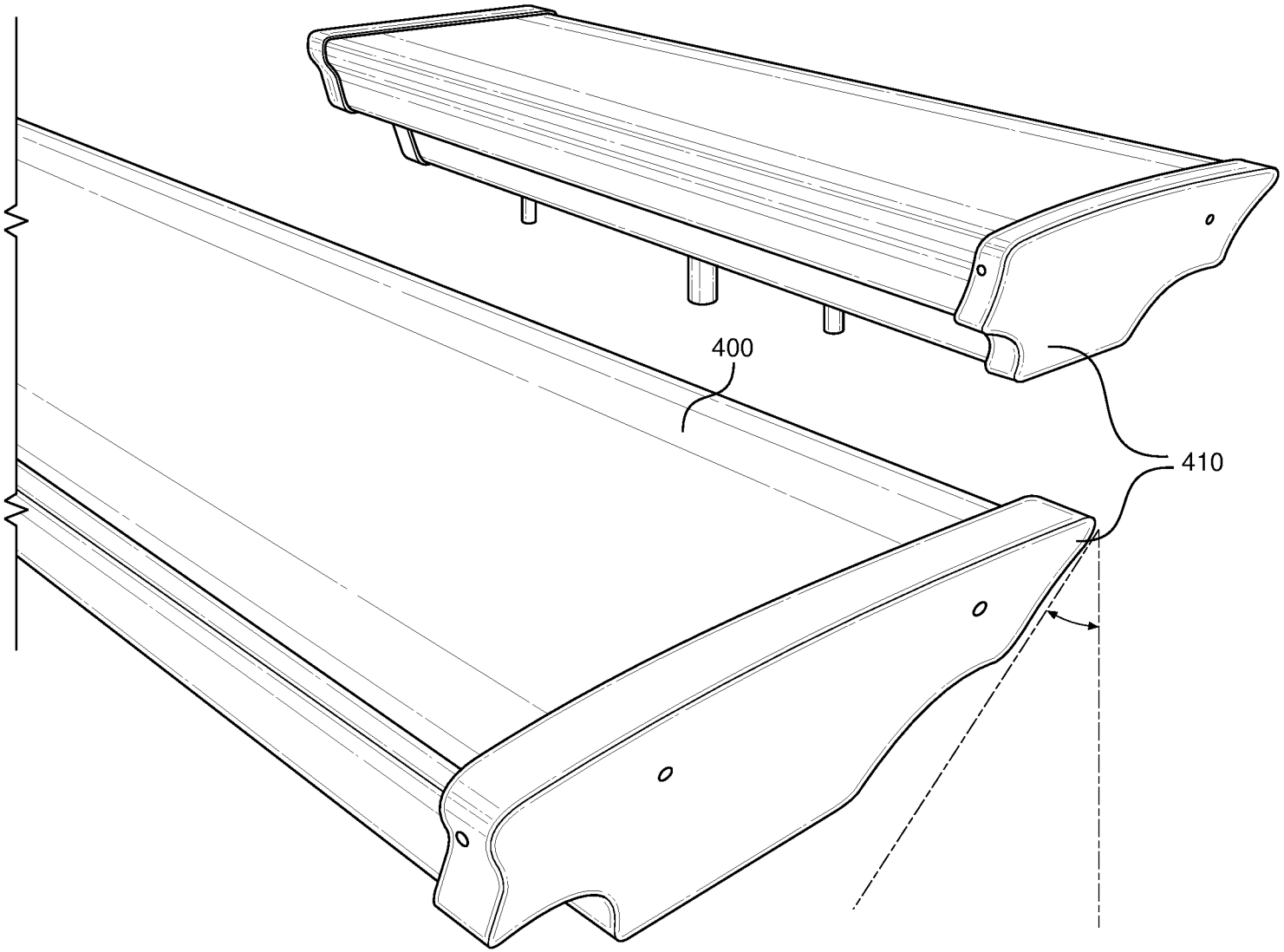
FIG. 4 provides partial perspective views of a polymeric radome for a sector antenna, in accordance with the present disclosure.

FIG. 4 provides partial perspective views of a polymeric radome 400 for a sector antenna, in accordance with the present disclosure. In some embodiments, the polymeric radome 400 include metal or metalized (not plastic) end caps 410 which are designed to be set at a prescribed angle and with a prescribed geometry, resulting in a low loss mechanical housing for the sector antenna. In one embodiment, these metal end caps may be tilted at a prescribed angel of approximately 20 degrees to address any interfering side lobes. Both the two-port and four-port sector antennas can incorporate the polymeric radome 400. The metal or metalized end caps 410 may be assembled to a metal base structure at the prescribed angle. The metal base structure is later described in greater detail in view of FIGS. 7A-7E.

Figure 5A:
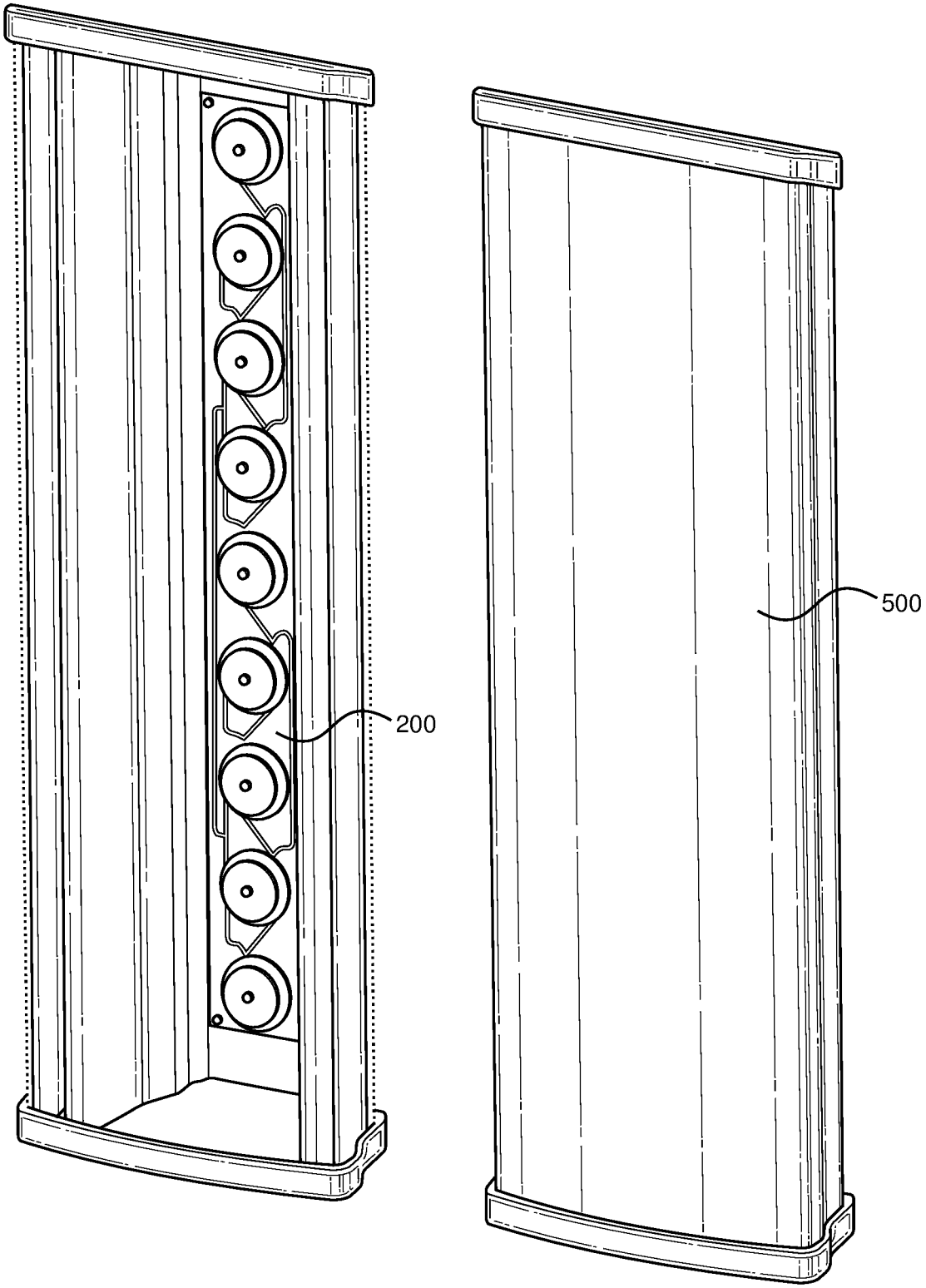
FIGS. 5A and 5B depict top down cross sectional schematic diagrams of example two-port and four-port sector antennas, respectively.
Figure 5B:
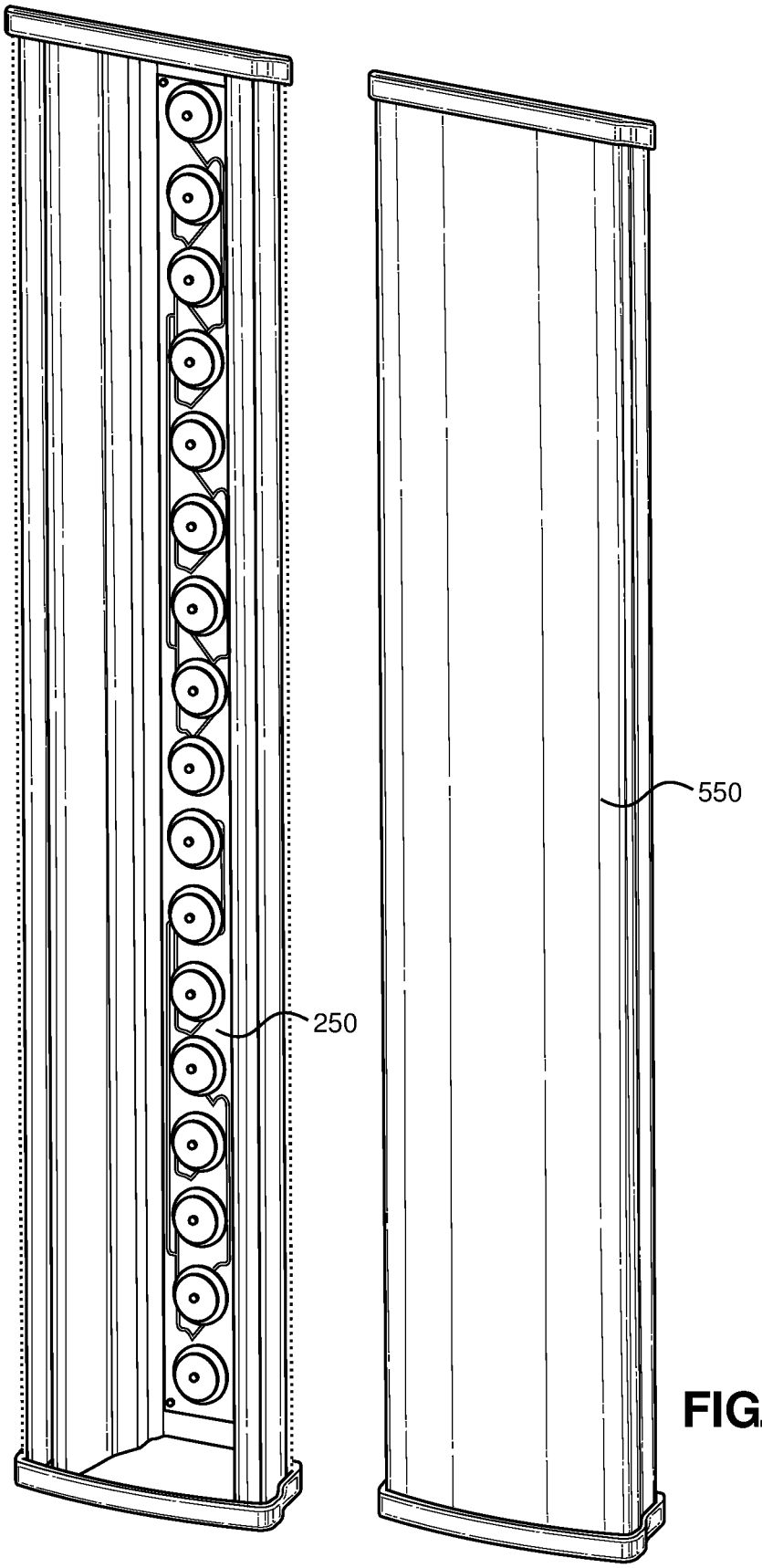

FIGS. 5A and 5B depict top down cross sectional schematic diagrams of example two-port and four-port sector antennas, respectively. Specifically, FIG. 5A shows an example two-port sector antenna with its array 200 of elements. The two-port sector antenna also includes a polymeric radome 500. Similarly, FIG. 5B shows the four-port sector antenna with its array 255 of elements. The four-port sector antenna also includes a polymeric radome 550.

Figure 6A:
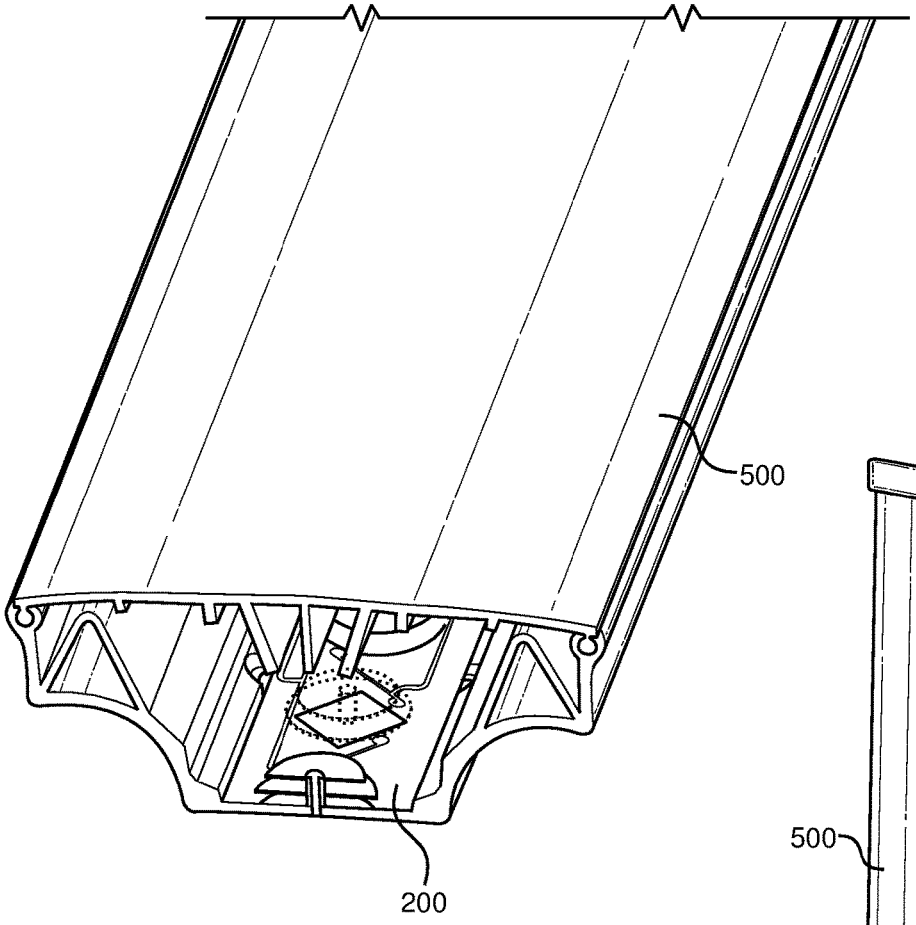
FIGS. 6A and 6B provide top down cross sectional views of an example sector antenna, in accordance with the present disclosure.
Figure 6B:
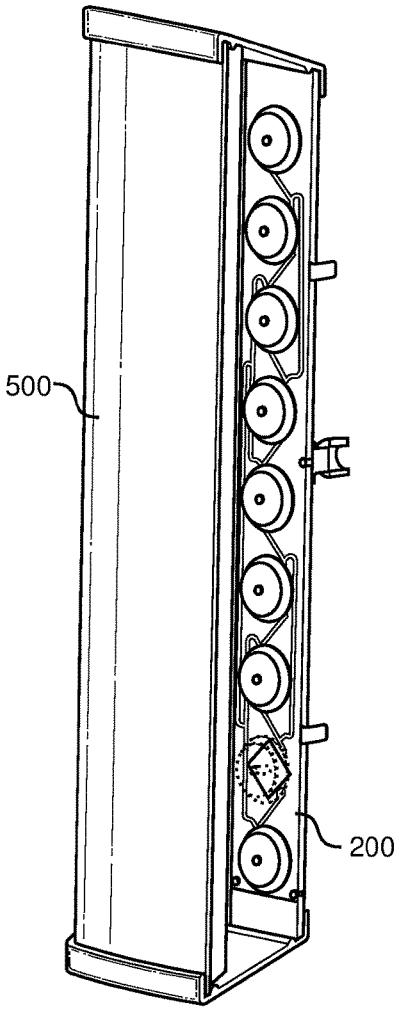

FIGS. 6A and 6B provide top down cross sectional views of an example sector antenna, in accordance with the present disclosure, having a polymeric radome 500 and its linear array. In some embodiments, a sector antenna is placed vertically on a pole, perpendicular to the horizontal axis. FIGS. 6A and 6B specifically shows the two-port sector antenna having a linear array 200 of nine elements, with the polymeric radome 500 covering the linear array 200 from outside environmental factors.

Figure 7B:
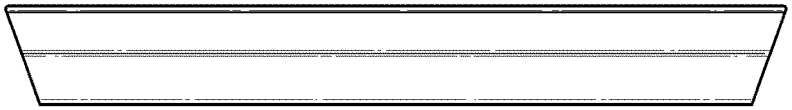
FIGS. 7A, 7B and 7C are top, side and bottom cross sectional views, respectively, of an example ground plane (base).
Figure 7D:
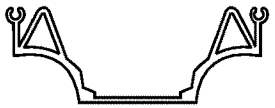
FIG. 7D is a cross sectional view of one end of a ground plane.
Figure 7E:
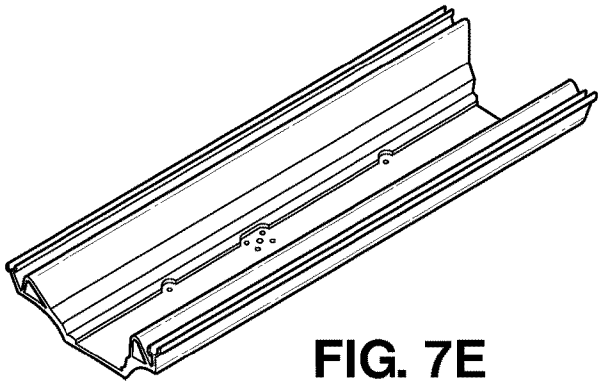
FIG. 7E is a perspective cross sectional view of a ground plane.
Figure 7A:
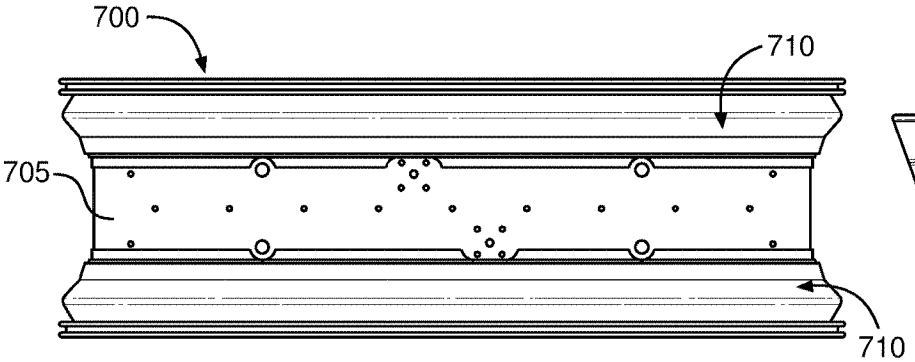
Figure 7C:
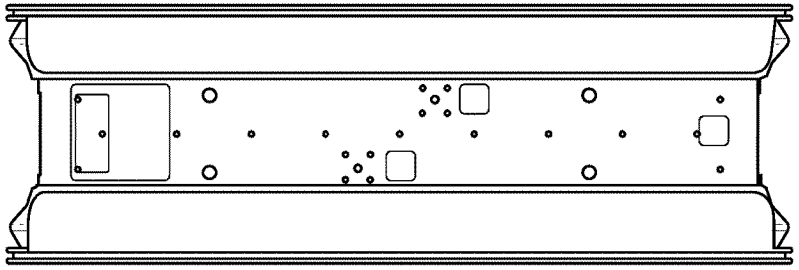

As mentioned earlier, the bottom layer of the PCB of the sector antenna is ground plane (base). That is, sector antennas can be formed using a vertical array of antenna elements placed over a metallic ground plane. FIGS. 7A, 7B and 7C are top, side and bottom cross sectional views, respectively, of an example ground plane (base). FIG. 7D is a cross sectional view of one end of a ground plane. FIG. 7E is a perspective cross sectional view of a ground plane.

In accordance with various embodiments of the present disclosure, both the two-port and four-port sector antennas incorporate a metal or metalized structure 700 with prescribed geometry, as depicted in FIGS. 7A-E. The structure enhances antenna performance, improves side-lobe rejection, and specifically improves the front-to-back ratio. This structure also serves as a "base" on which the PCB and parasitic patch assemblies are mounted. Thus, the cross-section of the ground plane as depicted in FIGS. 7A-E is key, since it has a profound impact on both the main-lobe gain and the side-lobe rejection. Also, any deviation from the cross-section profile for the ground plane as depicted in FIGS. 7A-E is likely to degrade antenna performance. The prescribed metal geometry as depicted in FIGS. 7A-E results in an antenna front-to-back ratio on both the two-port and four-port antennas that is equal to or greater than 43 dB.

As discussed earlier, and as depicted in FIGS. 7A-E, in accordance with various embodiments of the present technology, the prescribed geometry of the structure supports an antenna PCB for a long and narrow sector antenna. Such a design allows for sector antennas to be optimized towards the goal of maximizing gain and minimizing side lobes. In certain embodiments, the antenna PCB is located in the center groove 705 of the metal structure 700, with a plurality of antenna elements linearly arranged in the middle of the PCB and optimally spaced for antenna performance. Also, in some embodiments, chokes 710 are disposed on both sides of the PCB. The chokes 710 act like speedbumps to antenna signals, which allow for high side-lobe rejection, and thus mitigate interference as much as possible. In some embodiments, as shown in FIG. 7D, the chokes may have a U-shaped geometry.

The sector antennas described herein can be arranged in a variety of configurations. Sector antennas may be stacked one on top of another, or one sector antenna may be turned in a first direction while another sector antenna may be turned in a second direction to provide for broader coverage. Sector antennas may also be arranged side by side, which is advantageous for tower deployments given that it may be cheaper to deploy such antennas on towers.

The terminology used herein is for the purpose of describing particular embodiments only and is not intended to be necessarily limiting of the disclosure. As used herein, the singular forms "a," "an" and the are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof.

Although the terms first, second, etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing and/or other any other types of manufacturing. For example, some manufacturing processes include three dimensional (3D) printing, laser cutting, computer numerical control (CNC) routing, milling, pressing, stamping, vacuum forming, hydroforming, injection molding, lithography and/or others.

Any and/or all elements, as disclosed herein, can include, whether partially and/or fully, a solid, including a metal, a mineral, a ceramic, an amorphous solid, such as glass, a glass ceramic, an organic solid, such as wood and/or a polymer, such as rubber, a composite material, a semiconductor, a nano-material, a biomaterial and/or any combinations thereof. Any and/or all elements, as disclosed herein, can include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, non-transparency, luminescence, anti-reflection and/or holographic, a photo-sensitive coating, an electronic and/or thermal property coating, such as for passivity, insulation, resistance or conduction, a magnetic coating, a water-resistant and/or waterproof coating, a scent coating and/or any combinations thereof.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" may be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings is turned over, then the elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "lower" can, therefore, encompass both an orientation of above and below.

The description of the present disclosure has been presented for purposes of illustration and description, but is not intended to be exhaustive or limited to the present disclosure in the form disclosed. Many modifications and variations will be apparent to those of ordinary skill in the art without departing from the scope and spirit of the present disclosure. Exemplary embodiments were chosen and described in order to best explain the principles of the present disclosure and its practical application, and to enable others of ordinary skill in the art to understand the present disclosure for various embodiments with various modifications as are suited to the particular use contemplated.

While various embodiments have been described above, it should be understood they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. A sector antenna system, comprising:

a linear antenna array for the sector antenna, configured to implement slant 45-degree polarizations, to exploit beamforming gain, the linear antenna array comprising a plurality of patch antenna elements that are connected through a corporate feed, the linear antenna array located on a printed circuit board (PCB) of the sector antenna, each of the plurality of patch antenna elements having bi-level parasitic patch element assemblies of varying diameter discs, for high bandwidth operation with low return-loss, the PCB having two layers comprising the corporate feed and a ground plane, the two layers separated by a dielectric substrate, with chokes disposed on opposing sides of the PCB for high side-lobe rejection, the chokes coupled to surfaces that extend upwardly and away from a lower linear surface of the ground plane, the ground plane comprising a channel that receives the PCB; and the ground plane having a cross-section profile configured in such a way as to support the linear antenna array and the PCB, in order to increase main-lobe gain and side-lobe rejection.

2. The sector antenna system of claim 1, wherein a deviation from the cross-section profile for the ground plane degrades antenna performance of the sector antenna.

3. The sector antenna system of claim 1, wherein the linear antenna array is for a two-port sector antenna having nine patch antenna elements and nine corresponding bi-level parasitic patch element assemblies.

4. The sector antenna system of claim 1, wherein the linear antenna array is for a four-port sector antenna having seventeen patch antenna elements and seventeen corresponding bi-level parasitic patch element assemblies.

5. The sector antenna system of claim 1, wherein each of the plurality of bi-level parasitic patch assemblies are assembled at each patch antenna element, and electrically shorted to each patch antenna element, to improve beamwidth and bandwidth performance.

6. The sector antenna system of claim 1, wherein each of the plurality of patch antenna elements has a bi-level parasitic patch assembly comprising two discs having varying diameters, optimally spaced for antenna performance.

7. The sector antenna system of claim 1, further comprising a polymeric radome to provide a low loss mechanical housing for the sector antenna.

8. The sector antenna system of claim 7, wherein the polymeric radome comprises metal or metalized end caps which are designed to be set at a prescribed angle.

9. The sector antenna system of claim 8, wherein the metal or metalized end caps of the polymeric radome is adapted to be tilted at a prescribed angle of approximately 20 degrees to address any interfering side lobes of the sector antenna.

10. The sector antenna system of claim 1, wherein the PCB and parasitic patch assemblies are mounted on a base of a metal or metalized structure, the structure having a prescribed geometry such as to enhance antenna performance, improve side-lobe rejection and improve front to back ratio.

11. The sector antenna system of claim 10, wherein the structure is configured geometrically such that the front to back ratio of the sector antenna is equal to or greater than 43 dB.

12. A sector antenna system, comprising:

a linear antenna array for the sector antenna, configured to implement slant 45-degree polarizations, to exploit beamforming gain, the linear antenna array comprising a plurality of patch antenna elements that are connected through a corporate feed, the linear antenna array located on a printed circuit board (PCB) of the sector antenna, each of the plurality of patch antenna elements having parasitic patch element assemblies, the PCB having two layers comprising the corporate feed and a ground plane, the two layers being separated by a dielectric substrate, with chokes disposed on opposing sides of the PCB for high side-lobe rejection, the PCB being placed on a lower linear surface of the ground plane, each of the chokes coupled to an arcuate surface that extends above and away from the lower linear surface; and the ground plane having a cross-section profile configured in such a way as to support the linear antenna array on the PCB, in order to increase main-lobe gain and side-lobe rejection.

13. A linear array for a sector antenna, comprising: a plurality of patch antenna elements that are connected through a corporate feed and are arranged for high antenna gain, the linear array located on a printed circuit board (PCB) of the sector antenna, each of the plurality of patch antenna elements having parasitic patch element assemblies, the PCB having two layers comprising the corporate feed and a ground plane, the two layers being separated by a dielectric substrate, with chokes disposed on opposing sides of the PCB for high side-lobe rejection, each of the chokes coupled to an arcuate surface that extends above and away from a lower linear surface of the ground plane.

14. The linear array of claim 13, wherein the linear array is for a two-port sector antenna having nine patch antenna elements and nine corresponding bi-level parasitic patch element assemblies.

15. The linear array of claim 13, wherein the linear array is for a four-port sector antenna having seventeen patch antenna elements and seventeen corresponding bi-level parasitic patch element assemblies.

16. The linear array of claim 13, wherein each of the plurality of parasitic patch assemblies are assembled at each patch element, and electrically shorted to each patch element, to improve the beamwidth and bandwidth performance.

17. The linear array of claim 13, wherein each of the plurality of patch antenna elements has a bi-level parasitic patch assembly comprising two discs having varying diameters, optimally spaced for antenna performance.

18. The linear array of claim 13, further comprising a structural member that extends above the arcuate surface.

19. The linear array of claim 18, wherein the structural member is a hollow triangular object that extends along a length of the ground plane, wherein a lower edge of the hollow triangular object is defined by the arcuate surface.

20. The linear array of claim 13, wherein the PCB and parasitic patch assemblies are mounted on a base of a metal or metalized structure, the structure having a prescribed geometry such as to enhance antenna performance, improve side-lobe rejection and improve front to back ratio.

* * * * *